US005860343A

United States Patent [19]

Koch et al.

[11] Patent Number: 5,860,343

[45] Date of Patent: Jan. 19, 1999

[54] SLICING MACHINE FOR FOODS

[75] Inventors: Klaus Koch, Balingen; Viktor Fecker, Hechingen, both of Germany

[73] Assignee: Bizerba GmbH & Co. KG, Germany

[21] Appl. No.: 727,601

[22] PCT Filed: Apr. 12, 1995

[86] PCT No.: PCT/EP95/01352

§ 371 Date: Oct. 16, 1996

§ 102(e) Date: Oct. 16, 1996

[87] PCT Pub. No.: WO95/32846

PCT Pub. Date: Dec. 7, 1995

[30] Foreign Application Priority Data

May 26, 1994 [DE] Germany ..... 44 18 351.8

[51] Int. Cl.[6] ..... B26D 7/08

[52] U.S. Cl. ..... 83/168; 83/93.2; 83/105; 83/166; 83/856; 83/698.21; 83/113; 83/121; 83/145; 15/93.1

[58] Field of Search ..... 83/932, 113, 121, 83/145, 162, 163, 698.21, 856, 165, 105, 167, 168, 94, 166, 703, 713, 714, 707, 478, 545, 547, 491, 591; 15/93.1

[56] References Cited

U.S. PATENT DOCUMENTS

| | | | |
|---|---|---|---|
| 1,069,274 | 8/1913 | Luschka | 83/168 X |
| 1,142,901 | 6/1915 | McCormick | 83/121 X |
| 1,444,860 | 2/1923 | Wile | 83/167 X |
| 1,641,180 | 9/1927 | Lucey | 83/121 |
| 1,756,348 | 4/1930 | Folk | 83/121 X |
| 1,945,269 | 1/1934 | Freudenberg | 83/167 X |
| 1,957,190 | 5/1934 | Wood | 15/93.1 |
| 1,960,421 | 5/1934 | Van Berkel . | |
| 2,047,476 | 7/1936 | Johnson | 83/167 X |
| 2,050,786 | 8/1936 | Folk | 83/165 X |
| 2,055,817 | 9/1936 | Folk | 83/121 X |
| 2,151,862 | 3/1939 | Meeker et al. | 83/167 X |
| 2,199,267 | 4/1940 | Meeker et al. | 83/167 X |
| 2,783,805 | 3/1957 | Wielechowski | 83/167 X |
| 3,080,784 | 3/1963 | Schneider | 83/698.21 X |
| 3,669,089 | 6/1972 | Swenson | 125/11.01 |
| 4,752,149 | 6/1988 | Paeschke | 403/129 |

FOREIGN PATENT DOCUMENTS

| | | |
|---|---|---|
| PS 6 04 898 | 10/1934 | Germany . |
| 922751 | 1/1955 | Germany . |
| 15 441 III 66b | 9/1955 | Germany . |
| B-11 33 862 | 7/1962 | Germany . |
| AS 12 68 010 | 5/1968 | Germany . |
| C-61 789 | 5/1948 | Netherlands . |
| A-N 19826 | of 1914 | United Kingdom . |
| 252621 | 6/1926 | United Kingdom . |
| 268120 | 3/1927 | United Kingdom . |
| 307247 | 3/1929 | United Kingdom . |
| 607880 | 9/1948 | United Kingdom . |
| 804553 | 11/1958 | United Kingdom . |

*Primary Examiner*—Rinaldi I. Rada
*Assistant Examiner*—Boyer Ashley
*Attorney, Agent, or Firm*—Barry R. Lipsitz; Ralph F. Hoppin

[57] ABSTRACT

A slicing machine for foods includes a circular knife with a peripheral cutting edge mounted rotatingly in a substantially vertical position on a machine housing. The knife defines a substantially vertical cutting plane. A knife protection ring is secured to the machine housing and surrounds a substantial portion of the cutting edge. A carriage for receiving a product to be cut is mounted on the housing on one side of the cutting plane for reciprocating movement in a direction parallel to the cutting plane. A scraper is arranged on an opposite side of the cutting plane to cover part of a face of the circular knife. The scraper is mounted pivotably about a pivot axis defined by a pivot bearing so as to be pivotable from an operating position to a cleaning position. The pivot axis is arranged above the center of the circular knife essentially horizontal and parallel to the cutting plane.

16 Claims, 3 Drawing Sheets

SLICING MACHINE FOR FOODS

BACKGROUND OF THE INVENTION

The invention relates to a slicing machine for foods with a machine housing, a circular knife mounted rotatingly therein, a knife protection ring secured to the machine housing, a carriage for receiving a product to be cut displaceable back and forth along the circular knife and a scraper means arranged on the opposite side of the circular knife and pivotable away from the circular knife.

The purpose of a scraper means on a slicing machine for cold meats is, on the one hand, to remove food remains adhering to the knife and, on the other hand, to deflect the cut slices of food in a favorable angle with respect to the circular knife and the machine housing as well as set them down by means of the force of gravity directly afterwards or after further transport over additional conveying elements.

Since this scraper means comes into contact with the food (e.g. cold meats) to be cut and, in addition, cut remains are deposited in the gap between circular knife and scraper means, it is necessary to clean this area more frequently in order to meet requirements of hygiene. This is, however, only possible when the scraper means is separated from the knife such that it is easily accessible from all sides.

DE-PS 604 898 discloses a scraper means for a slicing machine which is mounted on a vertical carrier pin and can be adjusted in its position horizontally and vertically. For cleaning, the scraper means must be removed completely from the slicing machine after loosening of a setscrew.

The published German patent application Sch 15 441 III 66 b discloses a scraper means consisting of transparent material which is pivotally mounted by means of a hinge secured vertically on the machine housing. The scraper means is pivoted away from the knife for cleaning and held in the scraping position by a resilient clamping device.

The known solutions have the disadvantage that the cleaning, which must be undertaken very frequently on slicing machines for reasons of hygiene, can be carried out only with difficulty or inadequately. The reason for this is that the attachment or locking means and the pivot bearing of the scraper means have recesses, corners, grooves and gaps which are hard to reach, and the scraper means is not easily accessible on all sides for cleaning even in its position pivoted away from the knife. Moreover, it is disadvantageous that all the parts are located in the main area of soiling, i.e. in the zone of the slicing machine touching the food. In this respect, the removal or pivoting away of the scraper means from the knife for the purpose of cleaning is also time-consuming or complicated.

The object of the invention is to mount the scraper means on a generic slicing machine such that, for the cleaning of the slicing machine, it can easily be moved away from the circular knife with a manual movement into the cleaning position, in which it is accessible from all sides and at the same time remains connected to the machine.

SUMMARY OF THE INVENTION

The object is accomplished by the invention in the case of a generic slicing machine in that the scraper means is mounted so as to be pivotable upwards out of its operating position into a cleaning position about a pivot axis of a pivot bearing which is located above the central axis of the circular knife, is essentially horizontal and arranged parallel to the cutting plane of the circular knife.

Additional developments of the invention are disclosed.

The advantages to be achieved with the invention in its various embodiments are to be seen, in particular, in the fact that the scraper means is pivotable away from the knife into the cleaning position with a simple manual movement and in this position is well accessible from all sides and easy to clean. Moreover, it remains connected to the machine and cannot, therefore, become lost. Also, an optimum adjustment is therefore permanently maintained. A false position of the scraper means, i.e. in cleaning position instead of operating position at the beginning of a slicing process, is immediately noticed because the scraper means is thereby conspicuously arranged at an obvious place and projecting freely upwards.

Additional features and advantages of the invention are to be seen in the following: The scraper means takes up a stable position in its cleaning position. This is brought about by a pivoting of the center of gravity of the scraper means beyond the vertical, as well as, where applicable, by an additional brake spring element which is provided in the pivot bearing of the scraper means. The latter prevents the uncontrolled falling back of the scraper means in any arbitrary intermediate position within its pivoting range of approximately 180°. This means that any possible risk of accidents, e.g. pinching the fingers, is avoided.

The scraper means can be returned to its operating position again with a simple manual movement, wherein this position is fixed by a self-acting snap closure and the compressive force occurring during the deflection of the cut slice can be positively cushioned via a fixing groove.

The distance of the scraper means from the circular knife can be adjusted exactly to a very small value by means of an adjusting screw. This is brought about by the position of the adjusting screw in the immediate vicinity of the cutting edge of the circular knife and of a scraper lip of the scraper means. This means that any drawing in of small cut remains and, following this, an uncontrolled catapulting of these cut remains away from the knife circumference is avoided. Moreover, the cutting of very thin slices is advantageously achieved by the likewise close setting of the deflector contour of the scraper means.

The favorable external shape of the scraper means without any poorly accessible corners, as well as the sealed design of the pivot bearing and of the snap closure prevent, on the one hand, the adherence of remains from the product to be cut and, on the other hand, facilitate cleaning.

The following description of preferred embodiments of the invention serves to explain the invention in greater detail in conjunction with the attached drawings.

DETAILED DESCRIPTION OF THE INVENTION

Figure 1:
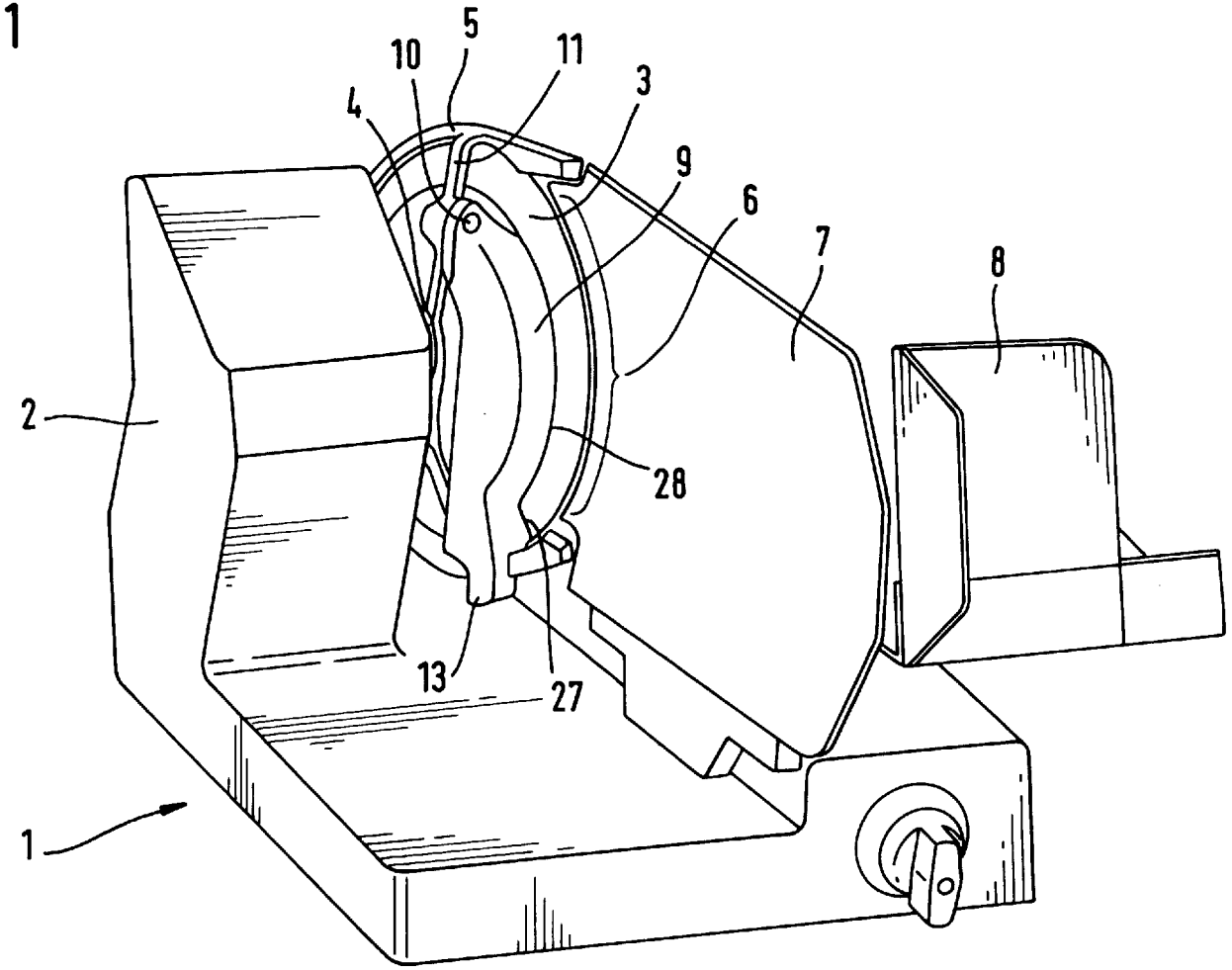
FIG. 1 shows a diagrammatic front view of a slicing machine for foods.

The slicing machine 1 for foods, e.g. cold meats, cheese, ham or the like, illustrated in FIG. 1 comprises a machine housing 2, in which a circular knife 3 driven by a motor is mounted for rotation. The hub 4 of a knife protection ring 5 in the shape of a spoked wheel is stationarily attached to the machine housing 2 and, for safety reasons, this ring encloses the circumferential edge of the circular knife 3 in a ring shape with the exception of the front cutting region 6. A stop plate 7 extending parallel to the cutting plane of the circular knife 3 for adjusting the slice thickness relative to the cutting plane is arranged in the cutting region 6 so as to be adjustable. A carriage 8 for receiving a product to be cut (not illustrated) is displaceable back and forth along the circular knife 3 parallel to the cutting plane. The product to be cut is fed to the rotating circular knife 3 lying on the carriage 8 and cut into slices while abutting against the stop place 7. During the cutting process, the slices are engaged by a scraper means 9, which lies closely against the circular knife 3 and is arranged opposite the carriage 8, and deflected by this away from the circular knife 3 and machine housing 2 in order to be set down immediately afterwards due to the force of gravity or after further transport via additional conveying elements known per se (not illustrated) are passed on and later set down.

Figure 2:
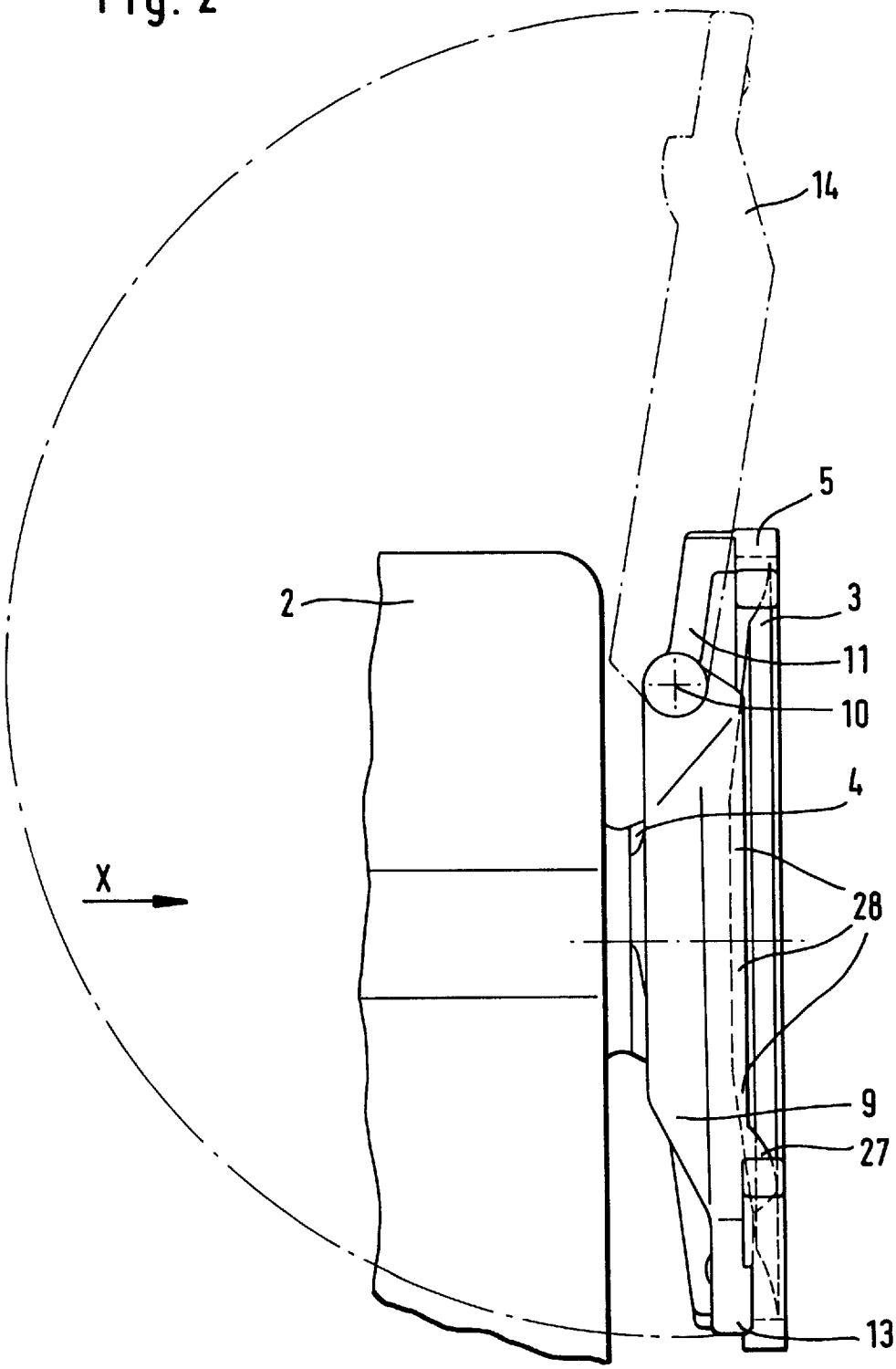
FIG. 2 shows a partial front view of the slicing machine from FIG. 1 in the region of a circular knife.
Figure 3:
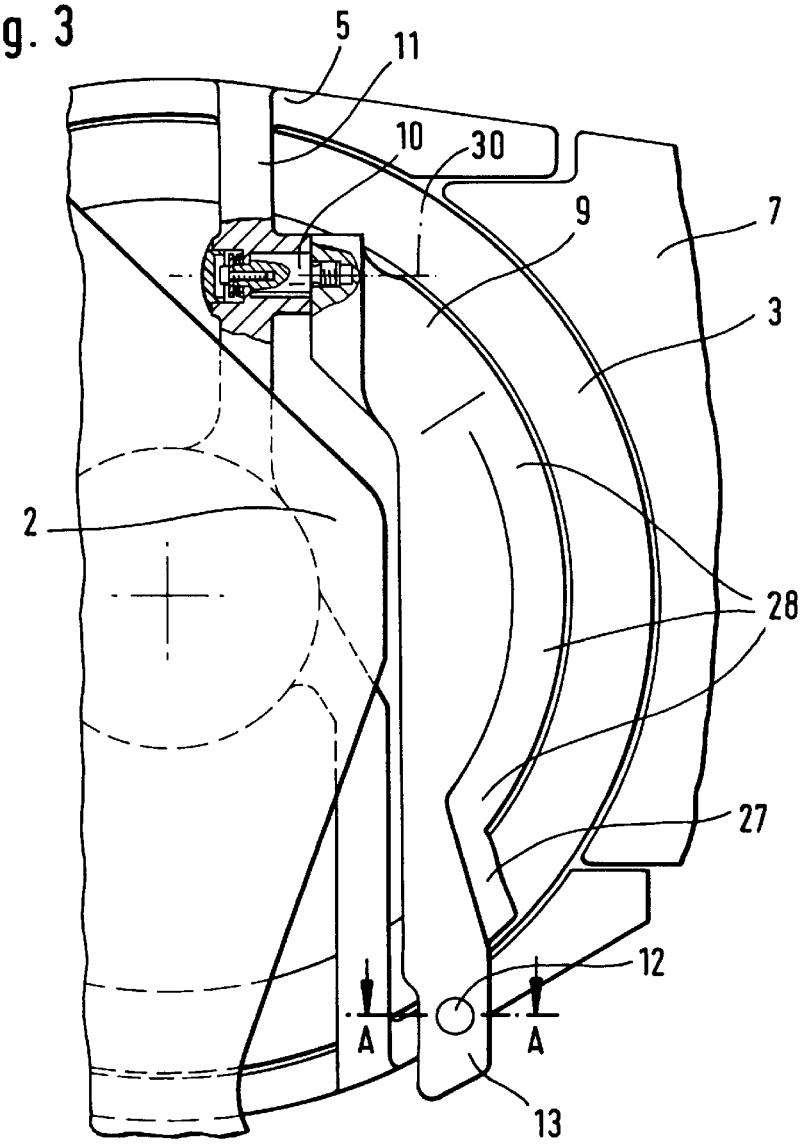
FIG. 3 shows a side view in the direction of arrow "X" in FIG. 2.

It is evident from FIGS. 2 and 3 that the scraper means 9 is pivotally mounted via a pivot bearing 10 on an upper spoke 11 of the knife protection ring 5 in an undetachable manner. The pivoting movement of the scraper means 9 takes place via a pivot axis 30 (FIGS. 3 and 4) which extends above the central axis of the circular knife 3 essentially horizontally and parallel to the cutting plane of the circular knife 3.

In the operating position indicated by solid lines, the scraper means 9 is fixed on the knife protection ring 5 in addition via a snap closure 12. For the cleaning of the slicing machine, it is manually grasped at a handle 13 located in the immediate vicinity of the snap closure 12 and pivoted upwards through approximately 180° away from the circular knife 3 into the cleaning position 14 (illustrated in FIG. 2 by dash-dot lines), in which it projects upwardly above the circular knife 3 freely accessible on all sides.

The center of gravity of the scraper means 3 is thereby pivoted beyond the vertical of the pivot bearing 10 (e.g., beyond a vertical line which extends upwardly from the pivot axis 30) into a stable position secured against any possible falling back. Moreover, as is still to be described, the friction torque in the pivot bearing 10 is additionally increased so that any falling back of the scraper means is also prevented in any arbitrary intermediate position within the pivoting range of preferably at least 180°.

Figure 4:
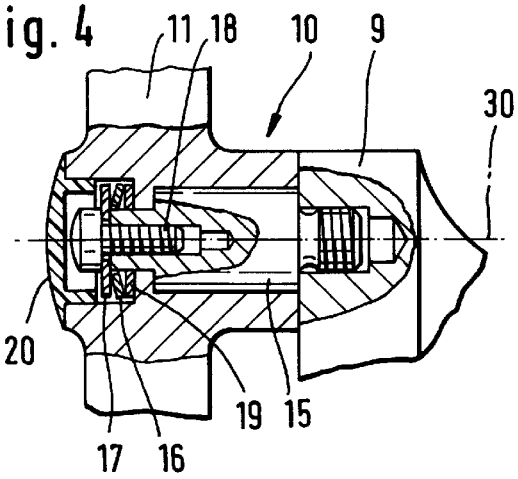
FIG. 4 shows an enlarged section of a pivot bearing of a scraper means shown in FIG. 3

In FIG. 4, an embodiment of the pivot bearing 10 is illustrated, with which the additional friction torque is generated by a brake spring element in the shape of a cup spring 16 acting axially in relation to a bearing pin 15. Other brake spring elements can also be used, e.g. a flexible plastic brake disk or other resilient elements which act axially or radially to the pivot bearing 10 and generate the necessary braking force. The bearing pin 15 is securely connected to the scraper means 9 and connected to the upper spoke 11 of the knife protection ring 5 via a securing disk 17 and a screw 18 in an undetachable manner. To compensate for axial production tolerances and for reasons of wear and tear, a washer 19 is provided. The pivot bearing 10 is covered with an elastic seal 20 for protection against soiling and for the better cleaning of the slicing machine.

The scraper means 9 and the machine housing 2 are adapted to one another in their external shape such that an unhindered pivoting of the scraper means 9 is made possible. Moreover, the external shape of the scraper means has no corners or the like which are poorly accessible and in which remains of products to be cut can become clogged, which makes the cleaning easier.

Figure 5:
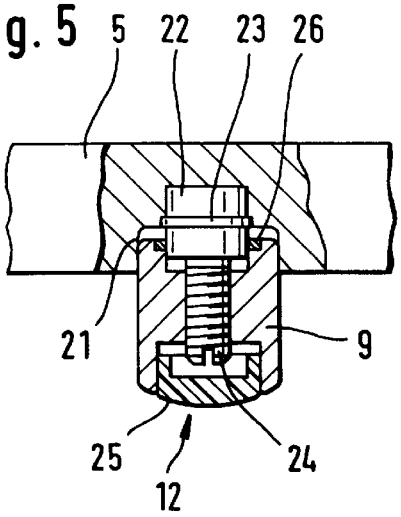
FIG. 5 shows a sectional view along the line A—A in FIG. 3.

It is apparent from FIGS. 3 and 5 how the scraper means 9 is fixed in its operating position by means of a groove 21 in the lower part of the knife protection ring 5 and secured with an additional snap closure 12. The snap closure 12 is, in the illustrated embodiment, designed as a magnetic closure means. Alternatively, other types of snap closure are also conceivable, e.g. locking or snap closures which cause the scraper means 9 to be secured in its operating position without any additional manual movement. The snap closure 12 consists in the illustrated embodiment of an adhesion magnet 22 secured in the knife protection ring 5, a cover disk 23 as corrosion protection for the magnet and an adjusting screw 24 of steel which is attached to the scraper means 9 and is attracted by the magnet 22 in the operating position of the scraper means 9.

With the adjusting screw 24, which is sealed by means of an elastic seal 25 and a sealing ring 26 and secured against rotation, the scraper means 9 can be adjusted to a very small distance in relation to the rotating circular knife 3. This is made possible by placing the adjusting screw 24 in the immediate vicinity of a scraper lip 27 of the scraper means 9. It is important above all that the scraper lip 27 of the scraper means 9 has as small a distance as possible to the circular knife 3 shaped concavely at this point in order to avoid the drawing in of small cut remains between the two parts and the subsequent uncontrolled catapulting of these cut remains away from the knife circumference. As small a distance to the circular knife 3 as possible has an advantageous effect as well for the deflector contour 28 of the scraper means 9 which, following the circular knife 3, is responsible for the additional deflection of the cut slices past the machine housing 2 because the cutting of very thin slices is thereby possible.

We claim:

1. A slicing machine for foods, comprising:

a machine housing having upper and lower portions;

a base for supporting the machine housing on a work surface, wherein the lower portion of the machine housing is closer to the base than the upper portion of the machine housing;

a circular knife with a peripheral cutting edge, said knife being rotatingly mounted about a knife axis in a substantially vertical position on said housing, said knife thereby defining a substantially vertical cutting plane;

a knife protection ring secured to the machine housing and surrounding a substantial portion of said cutting edge;

a carriage for receiving a product to be cut mounted on said housing on one side of said cutting plane for reciprocating movement in a direction parallel to said cutting plane;

a scraper arranged on an opposite side of said cutting plane to cover part of a face of said circular knife; and a pivot bearing arranged vertically above said knife axis and closer to the upper portion of the machine housing than the lower portion of the machine housing, wherein:

said pivot bearing defines an essentially horizontal pivot axis;

said pivot axis is essentially parallel to said cutting plane and perpendicular to said knife axis; and said scraper is mounted pivotably about said pivot axis so as to be pivotable from (i) an operating position adjacent to and facing said knife to (ii) a cleaning position vertically above and facing away from said knife.

2. The slicing machine of claim 1, wherein said pivot bearing is attached to an upper part of said knife protection ring.

3. The slicing machine of claim 1, wherein said pivot bearing comprises a brake spring element for providing a friction torque so that, when said scraper is in said cleaning position, said friction torque prevents said scraper from falling back from said cleaning position to any arbitrary intermediate position within a pivoting range of said scraper.

4. The slicing machine of claim 1, wherein said scraper is pivotable within its pivoting range unhindered by said machine housing.

5. The slicing machine of claim 1, wherein said scraper is pivotable through an angle of at least 180° from said operating position into said cleaning position.

6. The slicing machine of claim 5, wherein a center of gravity of said scraper is pivotable from said operating position into said cleaning position by pivoting past an imaginary vertical line which extends upwardly from said pivot axis, such that, when said scraper is in said cleaning position, said scraper is prevented from pivoting back past said imaginary vertical line.

7. The slicing machine of claim 1, further comprising:

an adjusting screw for threadedly engaging said scraper;

said adjusting screw having a sealing ring;

said adjusting screw facilitating an adjustment of a distance of said scraper from said circular knife when said scraper is in said operating position according to a depth of the threaded engagement of said adjusting screw in said scraper.

8. The slicing machine of claim 7, wherein said adjusting screw is placed in an immediate vicinity of a scraper lip of said scraper.

9. The slicing machine of claim 7, wherein said adjustment of said distance of said scraper from said circular knife is maintained even when said scraper is pivoted from said operating position to said cleaning position, and back to said operating position.

10. The slicing machine of claim 7, wherein said distance is selected to prevent food cuts from being drawn in between said scraper and said cutting knife.

11. The slicing machine of claim 1, wherein said knife protection ring comprises a lower portion having a groove, said groove being adapted to receive a portion of said scraper to secure said scraper in said operating position.

12. The slicing machine of claim 11, further comprising a magnetic closure for fixing said portion of said scraper in said groove.

13. The slicing machine of claim 11, further comprising a locking closure for fixing said portion of said scraper in said groove.

14. The slicing machine of claim 11, further comprising a snap closure for fixing said portion of said scraper in said groove.

15. The slicing machine of claim 14, wherein said pivot bearing and said snap closure of said scraper are each protected by an elastic seal.

16. The slicing machine of claim 14, wherein:

said scraper has a handle for carrying out a manual pivoting movement; and said handle is arranged in an immediate vicinity of said snap closure.

* * * * *